United States Patent [19]

Hayashi et al.

[11] Patent Number: 4,491,705

[45] Date of Patent: Jan. 1, 1985

[54] ELECTRICAL SWITCH

[75] Inventors: Hideo Hayashi; Iwao Takamatsu; Ikuo Nakai, all of Saitama, Japan

[73] Assignee: Fuji Electric Co., Ltd., Kawasaki, Japan

[21] Appl. No.: 434,621

[22] Filed: Oct. 15, 1982

[30] Foreign Application Priority Data

Oct. 16, 1981 [JP] Japan ..... 56-164080

[51] Int. Cl.[3] ..... H01H 33/18

[52] U.S. Cl. ..... 200/147 R; 200/144 R

[58] Field of Search ..... 200/147, 144

[56] References Cited

U.S. PATENT DOCUMENTS

| | | | |
|---|---|---|---|
| 2,687,462 | 8/1954 | Cellerini | 200/147 R |
| 2,995,638 | 8/1961 | Souchet | 200/147 R |
| 3,177,325 | 4/1965 | Pokorny | 200/147 R |
| 3,177,401 | 4/1965 | Clausing | 200/147 R |

*Primary Examiner*—Robert S. Macon

*Attorney, Agent, or Firm*—Brumbaugh, Graves, Donohue & Raymond

[57] ABSTRACT

Disclosed is a circuit breaker switch configuration in which a conducting member in the switch for connecting a switch terminal to a switch contact is shaped to form a loop current path, such that when a current flows in the switch, a magnetic field is established in the vicinity of the switch contacts. Such a magnetic field, which is appropriately oriented, serves to confine a plasma generated by an arc discharge which occurs between the switch contacts when the switch is initially opened. The confinement of the arc discharge plasma by the magnetic field reduces the extent of the plasma and permits the use of smaller arc-extinguishing means in the switch and affords more rapid extinguishment of the arc discharge.

2 Claims, 6 Drawing Figures

(PRIOR ART)

FIG. 3
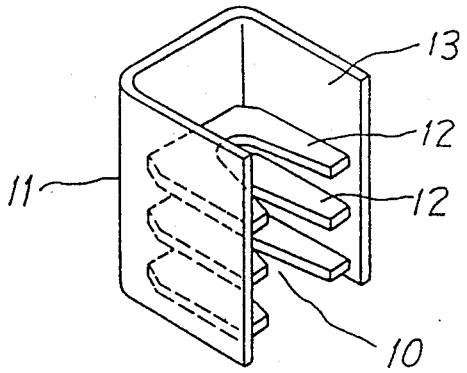
(PRIOR ART)
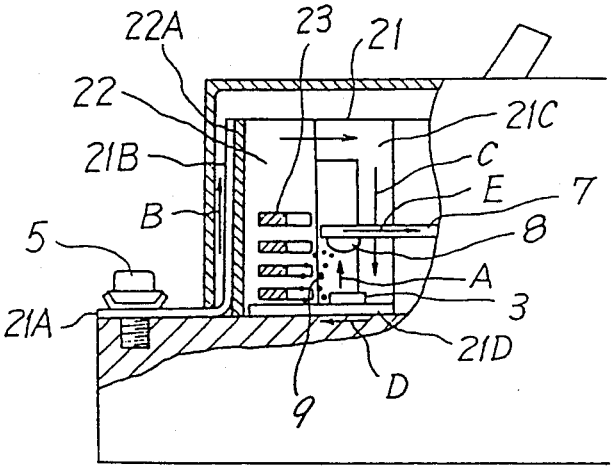
FIG. 4

ELECTRICAL SWITCH

BACKGROUND OF THE INVENTION

This invention relates to electrical switch apparatus of the electro-mechanical type, and more particularly to a switch apparatus suitable for use in circuit breaker applications.

Circuit breakers commonly used for protecting an electrical wiring network from current overloads and short circuits typically include a mechanical switch which is normally closed but which is opened when a tripping mechanism in the circuit breaker senses a current exceeding a predetermined limit. Because the circuit breaker switch is opened while current is flowing between its contacts, an arc discharge generally occurs between the contacts when they are initially separated. Such an arc discharge generates a plasma in the region adjacent to the switch contacts and causes current conduction through the switch to continue after the contacts are separated until the discharge is extinguished. The duration of the arc discharge after contact separation depends upon such factors as the voltage across the switch and whether the current carried by the switch is AC or DC. The occurrence of the arc discharge in a circuit breaker switch is undesirable in that it slows the response of the circuit breaker to an overload condition and tends to shorten the life of the contacts. Therefore, switches used in circuit breakers commonly include provisions for extinguishing such arc discharges.

FIG. 1 shows a cross-sectional view of a conventional configuration for a circuit breaker switch. The switch includes a terminal screw 5, a fixed contact electrode 3, a movable contact electrode 8, a fixed conducting member 1 connecting the terminal screw 5 to the fixed contact electrode 3, a movable conducting member 7 connecting the movable contact electrode 8 to another terminal screw, which is not shown, and a tripping mechanism, which is also not shown, for selectively bringing the fixed and movable contact electrodes into contact under normal conditions and for automatically separating the contacts when the current limit for the circuit breaker is exceeded.

The fixed member 1 is depicted in an isometric view of FIG. 2, in which the same reference numerals used in FIG. 1 are used to denote the same portion and features of that component. The fixed member is formed from a strip of metal bent into the shape illustrated and has a tapped hole near one end thereof for receiving the terminal screw. A contact electrode 3 made from a suitable contact material is affixed, as by brazing, near the other end of the strip.

Referring again to FIG. 1, when the contact electrodes 3 and 8 of the switch are separated while a current is flowing in the switch, an arc discharge is struck between the electrodes generating a plasma in an arc zone, which is partially represented by the stippled region 9. Such an arc discharge gives rise to current conduction in the switch after separation of the electrodes. In order to extinguish the arc discharge, there is provided arc extinguishing means in the form of a plurality of grid members 12 made of a magnetic material and placed in close proximity to the aforementioned arc zone. The grid members are enclosed within a chamber 11 formed by insulating walls 13 on three sides of the grid members.

The chamber and grid members are illustrated in an isometric view of FIG. 3, in which the same reference numerals used in FIG. 1 are again used to denote the same features of those components. The grid members are planar and "C" shaped and are positioned in parallel at regular intervals along vertical direction within the chamber. The chamber 11 is open on one side to be in communication with the arc zone. The portion of arc discharge plasma, which enters the chamber and comes into contact with the grid members, is dispersed and cooled thereby. If the plasma in the arc zone becomes sufficiently cooled and dispersed by the grid members, the discharge is extinguished.

Referring again to FIG. 1, a deficiency of the conventional switch configuration is that as the current and/or voltage carried by switch is increased, the extent of the arc zone in the switch tends to become larger. Consequently, in a switch designed for high capacity applications, i.e., for carrying a high current and/or voltage, the chamber 11 must be made larger and the arms of the "C" shaped grid member must be made longer in order to provide sufficient cooling and dispersal of a more extensive plasma to cause rapid extinguishment of the discharge. However, the use of the larger chamber and longer grid members results in a switch construction which is undesirably large and costly to manufacture. Therefore, a need exists for a switch configuration for high capacity application which provides rapid extinguishment of an arc discharge during switch opening and has a construction which is more compact and less costly to manufacture.

SUMMARY OF THE INVENTION

The deficiencies of the conventional circuit breaker switch configuration discussed above are substantially improved by the present invention which is a switch configuration in which the fixed conducting member is shaped to form a current path which at least partially encircles a region of space which encompasses the arc extinguishing chamber, the arc zone and the fixed and movable contact electrodes and disposed such that when a current flows through the current path, a magnetic field is established which tends to confine the arc discharge plasma to a region adjacent to the grid members so as to facilitate rapid extinguishment of the arc discharge.

BRIEF DESCRIPTION OF THE DRAWING

FIG. 3 is an isometric view of the arc extinguishing chamber and grid members of the conventional circuit breaker switch;

FIG. 4 is a cross-sectional view of a circuit breaker switch according to an embodiment of the present invention;

DETAILED DESCRIPTION

Figure 1:
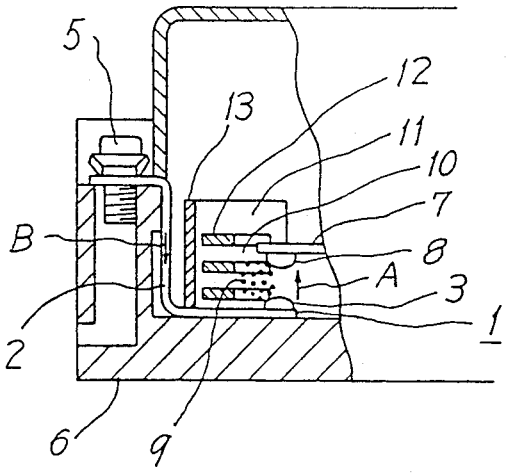
FIG. 1 is a cross-sectional view of a conventional circuit breaker switch.
Figure 2:
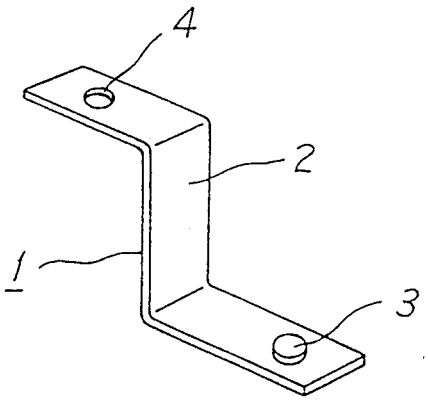
(PRIOR ART) FIG. 2
FIG. 2 is an isometric view of the fixed conducting member of the conventional circuit breaker switch.

Referring now to FIG. 4, there is shown a circuit breaker switch configuration according to an embodiment of the present invention. Reference numerals used in FIG. 1 are also used in FIG. 4 to denote like components or parts of the switch configuration illustrated therein. The switch configuration according to the present invention includes a terminal screw 5, a fixed contact electrode 3, a movable contact electrode 8, a fixed conducting member 21 connecting the terminal screw 5 to the fixed contact electrode 3, a movable conducting member 7 connecting the movable contact electrode 8 to another terminal screw, which is not shown, and a tripping mechanism, which has also been omitted from the depiction. Also included in the switch configuration of FIG. 4 is an arc extinguishing chamber 22 having insulating walls 22A enclosing a plurality of grid members 23 on three sides thereof, the grid members being regularly spaced in the vertical direction within the chamber. When the contact electrodes 3 and 8 are separated while a current flows therebetween, an arc discharge is struck generating a plasma in an arc zone which is partially represented by the stippled region 9. The chamber 22 is open on one side to be in communication with the arc zone.

Figure 5:
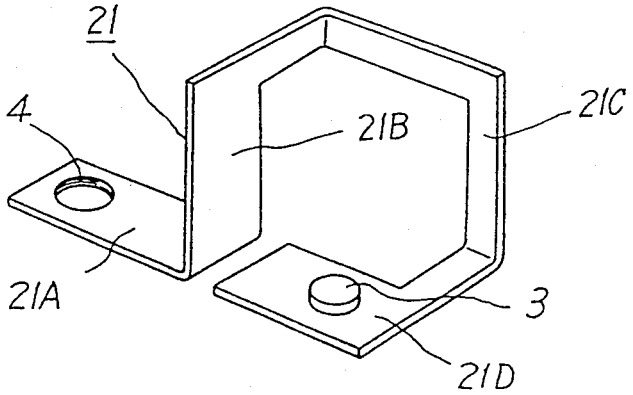
FIG. 5 is an isometric view of the fixed conducting member of the circuit breaker switch of FIG. 4.

The fixed member 21 is depicted in an isometric view of FIG. 5, in which the same reference numerals used in FIG. 4 are used to denote the same portions and features of the component. The fixed member, which is stamped from a metal plate and bent into the shape shown, includes a terminal section 21A having a tapped hole 4 for receiving the terminal screw. Connected at right angles to the terminal section 21A is a first "L" shaped section 21B having a vertical portion and a horiztonal portion. The horizontal portion of the first section 21B is connected at right angles to a second "L" shaped section 21C having a horizontal portion and a vertical portion. The vertical portion of the second section is connected at right angles to the third "L" shaped section 21D having a first portion which is parallel to the horizontal portion of the first section, and a second portion, which is parallel to the horizontal portion of the second section. The fixed contact electrode 3 is affixed to the second portion of the third section.

Figure 6:
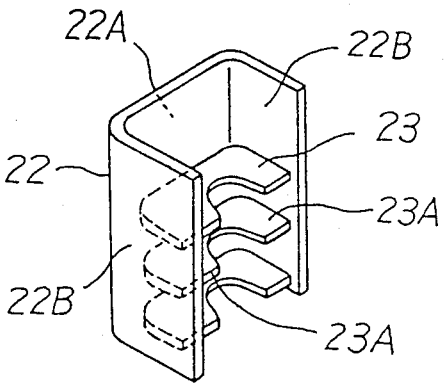
FIG. 6 is an isometric view of the arc extinguishing chamber and grid members of the circuit breaker switch of FIG. 4.

The arc extinguishing chamber 22 and the grid member 23 of the switch configuration of FIG. 4 are depicted in a isometric view of FIG. 6, in which the same reference numerals used in FIG. 4 are used to denote the same portions and features of those components. The chamber 22 is enclosed on three sides by a rear wall 22A and two side walls 22B. The side of the chamber opposite the rear wall is left open. The grid members 23 are planar and "C" shaped and are positioned in parallel at regular intervals along the vertical direction within the chamber.

Referring again to FIG. 4, the terminal section 21A of the fixed member is fastened to the switch housing by the terminal screw 5. The vertical and horizontal portions of the first section 21B of the fixed member extends along the rear wall 22A of the chamber 22, while the horizontal portion of the second section 21C extends along a side wall 22B of the chamber to a point beyond the chamber and the fixed contact electrode 3. The third section 21D of the fixed member lies in the same plane as the terminal section 21A, and the fixed contact electrode 3 is mounted near the open side of the chamber 22.

The current path through the switch is indicated by the arrows B, C, D, A and E. The portion of this current path through the fixed member 21 forms a nearly complete loop, indicated by arrows B, C and D. The loop encircles a region of space encompassing the chamber 22, the grid member 23, the contact electrodes 3 and 8 and the aforementioned arc zone. Thus, during normal operation of the switch when a current flows through the loop portion of the current path in the fixed conductor, a magnetic field is established which passes through the arc zone between the grid members and the contact electrodes in a direction perpendicular to the page of the drawing and extending into the page. As discussed above, when the contact electrodes are initially separated, an arc discharge is struck which causes current to continue to flow in the switch. Therefore, the plasma in the arc zone generated by the discharge is exposed to the aforementioned magnetic field which tends to confine the plasma to a region adjacent to the arc extinguishing chamber and the grid members. The phenomenon of plasma confinement by a magnetic field is well known and, therefore, need not be further explained. However, the unique switch configuration of the present invention which provides magnetic confinement of the arc discharge plasma during switch opening is novel.

Magnetic confinement of the arc discharge plasma in the above-described manner reduces the extent of the arc zone and permits the use of a smaller arc extinguishing chamber and grid members having shorter arms. Moreover, reducing the extent of the arc zone by magnetic plasma confinement also facilitates extinguishment of the arc discharge. It will be noted that as the current flowing through the switch increases, the magnetic field established by the current path through the fixed member also increase in magnitude to provide tighter confinement of the arc discharge plasma and thus offset the tendency of the arc zone to grow with increasing switch current. Therefore, the switch configuration according to the present invention provides a switch construction which is more compact and less costly to manufacture and affords more rapid extinguishment of the arc discharge.

Although it is preferred that the current path formed by the fixed member substantially encircles the region of space encompassing the chamber, the grid members, the arc zone and the contact electrodes, a current path which partially encircles such region of space, i.e., extending at least halfway around the region, would also provide the benefits of the present invention. It is to be noted that the current path through the fixed member in the conventional switch configuration of FIG. 1, indicated by the arrow B, does not provide such partial encirclement.

It will be understood that the above and other modifications, alterations and substitutions, as will be obvious to one skilled in the art, may be made to the switch configuration of FIG. 4 without departing from the spirit and scope of the present invention. For example, the third section 21D of the fixed member need not be in the same plane as the terminal section 21A, the shape of fixed member need not exactly follow that illustrated in FIG. 5, so long as such shape provides a current path which establishes a magnetic field passing through the arc zone between the grid members and the contact electrode in a direction substantially parallel to the opening of the chamber and the grid members, and such a current path may be provided by shaping a movable conducting member instead of a fixed conducting member. Furthermore, the switch configuration in accordance with the present invention may be useful in applications other than circuit breakers.

We claim:

1. A switch apparatus comprising:

a first and second terminal;

a first and second contact electrode;

a first conducting member connecting the first terminal to the first contact electrode;

a second conducting member connecting the second terminal to the second contact electrode;

means for selectively moving the relative positions of the first and second contact electrodes to be in contact with or separated from one another;

arc extinguishing means including a plurality of C-shaped grid members arranged in spaced parallel relation and positioned in proximity to the first and second contact electrodes and to an arc zone in which is generated an arc discharge plasma when the first and second contact electrodes are separated while a current is flowing therebetween;

characterized in that the first conducting member comprises a stamped and bent metal plate member shaped to form a current path which at least partially encircles a region of space which encompasses the grid members, the arc zone and the first and second contact electrodes, the plate member having a first L-shaped segment with one leg extending to the first terminal and the other leg extending adjacent to the plurality of grid members and in the direction perpendicular thereto, a second L-shaped segment having one leg extending from the first L-shaped segment in a direction parallel to the center of the C-shape of the grid members and another leg extending parallel to one side of the grid members, and a third L-shaped segment having one leg extending from the second L-shaped segment adjacent to one side of the C-shaped grid members and in a direction perpendicular thereto and another leg extending to the first contact electrode, the current path being disposed such that when a current flows therein, a magnetic field is established in the arc zone between the grid members and the first and second contact electrodes, the magnetic field acting to confine the arc discharge plasma to a region adjacent to the grid members.

2. A switch apparatus according to claim 1 wherein the first contact electrode and the first conducting member are fixed with respect to the second contact electrode and the second conducting member, the arc extinguishing means include a chamber partially enclosing the grid members and being in communication with the arc zone through an opening thereof, and the grid members have a planar shape and are regularly spaced in parallel along a vertical direction within the chamber, further characterized in that the first conducting member forms a current path which substantially fully encircles a region of space which encompasses the chamber, the arc zone and the first and the second contact electrodes, and the magnetic field established when a current flows in the current path has a component which is substantially parallel to the opening of the chamber and the planes of the grid members.

* * * * *